United States Patent [19]

Da Costa

[11] Patent Number: 4,968,223

[45] Date of Patent: Nov. 6, 1990

[54] GAS AND OIL COOLING SYSTEM FOR A HERMETIC COMPRESSOR

[75] Inventor: Caio M. F. N. Da Costa, Joinville, Brazil

[73] Assignee: Empresa Brasiliera de Compressores, Joinville, Brazil

[21] Appl. No.: 305,516

[22] Filed: Feb. 1, 1989

[30] Foreign Application Priority Data

Feb. 4, 1988 [BR] Brazil ..... 8800512

[51] Int. Cl.[5] ..... F04C 29/04

[52] U.S. Cl. ..... 417/366; 418/88; 418/85

[58] Field of Search ..... 417/312, 366, 372, 368; 418/88, 85

[56] References Cited

U.S. PATENT DOCUMENTS 4,518,330 5/1985 Asami et al. ..... 418/85
4,645,429 2/1987 Asami et al. ..... 417/312
4,781,542 11/1988 Ozu et al. ..... 417/369

*Primary Examiner*—John J. Vrablik
*Assistant Examiner*—David L. Cavanaugh
*Attorney, Agent, or Firm*—Darby & Darby

[57] ABSTRACT

Patent of Invention for "GAS AND OIL COOLING SYSTEM IN A HERMETIC COMPRESSOR" for small refrigeration machines of the type including an assembly wherein is defined a cylinder housing a piston driven from a crankshaft coupled to an electric motor and forming suction and compression chambers inside the cylinder, these elements being assembled inside a sealed shell acting as a lubricant oil sump and incorporating independent lubricant oil outlet and return tubes connected to a heat exchanger external to the shell. The system in question includes oil pumping means (20) assembled on the shaft (5) having its suction (24a) connected to the lubricant oil contained in the bottom of shell (1) and its discharge (24b) connected to the oil outlet tube (9a), the discharge (24b) of the oil pumping means (20) being maintained in fluid communication with the cylinder compression chamber (2) through a compressed refrigerant gas conduit (26a). Thus, the oil is drawn from the bottom of shell and pumped jointly with the refrigerant gas arriving to the pump discharge, through the heat exchanger (10) and returned to the inside of the shell (1).

11 Claims, 2 Drawing Sheets

GAS AND OIL COOLING SYSTEM FOR A HERMETIC COMPRESSOR

BACKGROUND OF THE INVENTION

The present invention relates to a hermetic compressor and, more particularly, to a joint gas and oil cooling system for a compressor of that type, used in small refrigeration and air conditioning systems.

The hermetic compressors, particularly rotary ones, must be provided with means to cool the electric motor during operation of the unit, order to prevent degradation of the windings insulation and the consequent damage to the electric motor, and with means to cool the lubricant oil, so that it does not warm up excessively thereby degrading and loosing its lubricant properties.

One of the known means to cool the electric motor consists in making the heated refrigerant gas that comes from the compressor discharge to pass through a heat exchanger or pre-cooler to be cooled therein and then to return to the inside of the compressor shell so as to cool the electric motor before being pumped to the refrigeration system.

In spite of cooling the motor, the above mentioned system of the prior art does not cool the lubricant oil. A means employed to perform the joint cooling of gas and oil is described on the patent document U.S. Pat. No. 4,569,645. That document describes a rotary compressor that comprises: a compression chamber; a main bearing and a secondary bearing; a rolling piston that rotates eccentrically, driven by an eccentric shaft inside the compression chamber, defining a high pressure chamber and a low pressure chamber, these elements being assembled inside a sealed shell in the lower portion of which is accumulated the lubricant oil that returns to the shell after being cooled in a heat exchanger external to the shell. During operation of the above mentioned set, the refrigerant gas is compressed and discharged through an ejector tube into a larger-diameter oil feed pipe that is in fluid communication with the lubricant oil stored inside the shell and is connected to the heat exchanger through an extension external to the shell. On being discharged in the oil feed pipe, the refrigerant gas carries the lubricant oil with it, making it circulate through the heat exchanger, where the oil and the refrigerant gas are cooled.

An operational drawback of the previous solution shown above becomes evident at each new start-up of the compressor, when connected to a refrigeration system. As the oil intake is done below the level of the sump, during compressor stops the oil will accumulate in the initial portion of heat exchanger, thereby causing an obstruction to the normal circulation of the gas that should be pumped after each new startup of the compressor.

This periodical pressure loss will, as a consequence, increase the daily power consumption of the refrigeration system. Another drawback of this previous technical solution results fron the manner whereby the oil is collected from the sump. Since the collection is done by drag, the gas ends up being quite diluted in the oil, causing foaming and bubbling, reducing the oil viscosity with a resulting decrease in its lubricant properties and its ability of acting as a sealant against compressed gas leakage between the movable parts inside the cylinder, from the compression chamber to the suction chamber.

OBJECTS OF THE INVENTION

It is an object of the present invention to provide a joint gas and oil cooling system for a hermetic compressor that eliminates the above mentioned drawbacks related to the solutions of the prior art.

It is also an object of the present invention to provide a cooling system of the considered type that is easy to assemble the compressor and of a low additional cost.

BRIEF DESCRIPTION OF THE INVENTION

These and other objects and advantages of the present invention are achieved by providing a hermetic compressor including: a cylinder housing a piston driven by a crankshaft and defining a compression chamber and a suction chamber inside the cylinder, the shaft being driven by an electric motor, these elements being assembled inside an hermetically sealed shell incorporating independent tube for oil exit and return and serving as a sump for the lubricant oil of the compressor unit, this unit also including a heat exchanger external to the compressor shell and in fluid communication with the lubricant oil exit and return tubes.

In accordance with the present invention, the gas and oil cooling system comprises: pumping means internal to the shell and having their suction in fluid communication with the oil sump in the shell and its discharge in fluid communication with the oil exit tube to the heat exchanger, through an oil discharge hole made longitudinally through the crankschaft; a compressed refrigerant gas conduit preferably defined at least partially by said longitudinal hole through the crankshaft and maintaining a fluid communication with the exit from the cylinder compression chamber and with the discharge of said oil pumping means, the oil exit tube and the heat exchanger being arranged at a level higher than the level of the oil sump insed the shell.

The above mentioned system allows the lubricant oil to be drawn from the sump and be pumped through the oil exit tube and into the heat exchanger, to return to the inside of the shell through the oil return tube.

Simultaneously, the gas compressed in the cylinder compression chamber is conveyed through the oil discharge hole in the crankshaft, flowing with the oil along the same path through the oil exit tube, the heat exchanger and the oil return tube to the inside of the shell.

In a preferred embodiment the oil return tube is arranged so as to cause the oil coming from the heat exchanger to be sprinkled over the motor, thereby cooling it.

In the new construction presented above, there is less refrigerant gas dilution in the lubricant oil, since the oil intake is done independently from the refrigerant gas flow, avoiding bubbling and foaming (as is the case in U.S. Pat. No. 4,518,330). In the system now claimed, the flow passing through the heat exchanger has two distinct phases, i.e., a liquid, lubricant oil phase and a gaseous, refrigerant gas phase. Another advantageous characteristic of the new solution results from the fact that the oil discharge conduit between the pump and the heat exchanger is not clogged by oil after each compressor stop, thereby preventing the pressure losses of the system at each new start-up. The present invention will be described below jointly with the appended drawings wherein:

Figure 1:
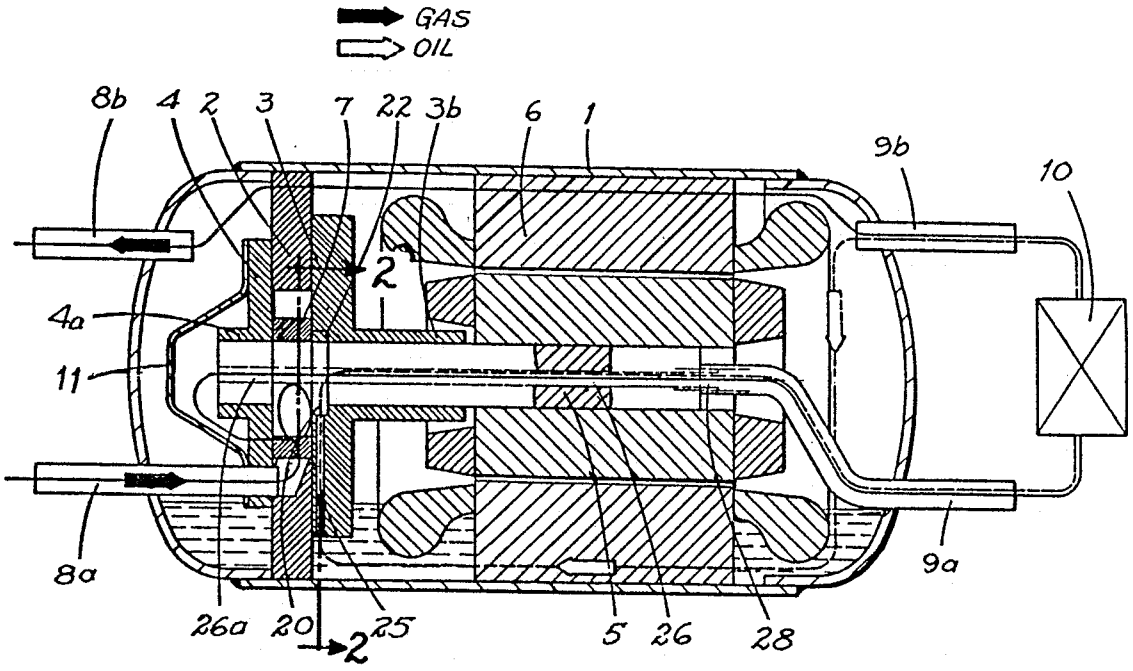
FIG. 1 illustrates a vertical, longitudinal cross section of a hermetic rotary horizontal-shaft compressor including the new cooling system.

In accordance with said illustration, the hermetic rotary compressor comprises a hermetic shell 1 with the lower portion thereof defining the lubricant oil sump and its inner portion housing a cylinder 2 frontally closed by the flanged portions 3 and 4 of a main bearing 3*a* and a subbearing 4*a* that support a horizontal crankshaft 5, which is fastened to the rotor of an electric motor 6 driving a rolling piston 7 inside cylinder 2.

The illustrated compressor also includes a tube 8*a* for admission of refrigerant gas inside the cylinder, a tube 8*b* for gas discharge from the shell, a tube 9*a* for lubricant oil discharge, a tube 9*b* for lubricant oil return to the inside of shell 1 and a heat exchanger 10 of any appropriate construction, external to shell 1 and having its lubricant oil inlet and outlet connected to the tubes 9*a* and 9*b* respectively for lubricant oil discharge and return.

In the illustrated configuration of the invention, the horizontal crankshaft 5 incorporates an oil pump 20, which assumes the shape of a cylindrical and eccentric portion 21, located in a medium point in the extension of crankshaft 5. The cylindrical and eccentric portion 21 is arranged so as to slide inside a cylindrical housing 22, concentrical to the axis of crankshaft 5 and provided—in the illustrated example—by a recess in the main bearing 3*a*.

Figure 2:
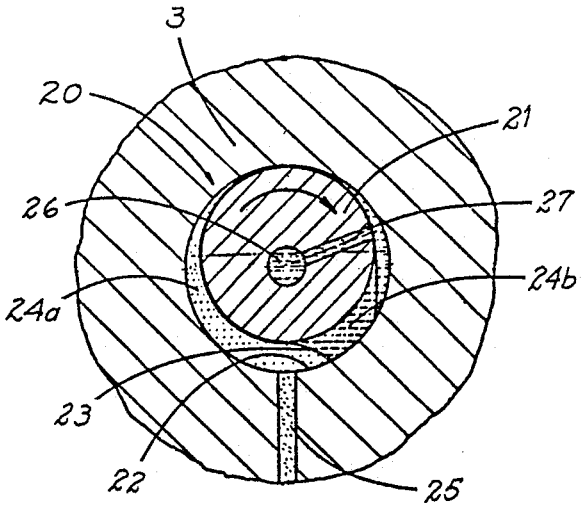
FIG. 2 illustrates a partial front view of the compressor of FIG. 1, representing the oil pump of the system according to a line 2—2 indicated on FIG. 1.

As illustrated or FIG. 2, the oil pump 20 is provided with a blade element 23 which is attached by one of its ends to the internal cylindrical surface of the cylindrical housing 22 for the purpose of separating the intake chamber 24*a* and discharge chamber 24*b* of pump 20.

Intake chamber 24*a* is connected to the oil sump of the shell 1 by means of a suction channel 25, which is made through the flanged portion 3 of the main bearing 3*a*. The discharge chamber 24*b* is connected to the oil discharge hole 26 by means of an oil discharge channel 27 made radially through the eccentric portion 21 of crankshaft 5.

The end of the crankshaft 5 is provided with a rotating tubular fitting 28 that interconnects the discharge hole 26 to the internal extension of the oil outlet tube of shell 1. The oil tubes 9*a* and 9*b* are connected to the heat exchanger 10 through appropriate pipes, represented on FIG. 1 through a pair of lines that represent the joint flow of gas and lubricant oil through the heat exchanger.

The compressor also includes a muffler 11 assembled in the flanged portion 4 of the sub-bearing 4*a*. That chamber receives the compressed gas from the cylinder 2 of the compressor, being in fluid communication with the longitudinal hole 26 for oil discharge through the corresponding extreme extension 26*a* of said hole.

With the above described constructive arrangement, the lubricant oil is drawn upwardly from the bottom of shell 1, through the suction channel 25 and, by action of pump 20, is pumped through the discharge channel 26, the oil outlet tube 9*a*, the heat exchanger 10 and the return tube 9*b*, to be stored again in the bottom of shell 1.

Simultaneously, the refrigerant gas compressed in cylinder 2 is conveyed to the muffler 11 and from there to the oil discharge hole 26 through its extension 26*a*. Upon crossing the discharge hole 26, the flow of compressed refrigerant gas joins the oil flow so as to have the same path of the oil through the heat exchanger 10 and back to the inside of shell 1. In the illustrated arrangement of a hermetic rotary horizontal shaft compressor, an operational advantage is also obtained by reason of the existence of the discharge hole 26 made through the crankshaft 5. As the shaft rotates, the joint flow of gas and lubricant oil through the hole 26 is submitted to an oil - gas separation action. This separation effect allows the lubricant oil to maintain its viscosity characteristics, preserving its lubrication ability and allowing it to act as a sealant against fluid leakages from the compression chamber to the suction chamber in the cylinder between the movable parts of the unit.

FIG. 1 illustrates a lubricant oil return tube 9*b* positioned so that the oil cooled in the heat exchanger is sprinkled over the electric motor upon its return to the inside of the shell. Notwithstanding the application of the new cooling system in a hermetic, rotary, horizontal shaft compressor has been described and illustrated herein, it should be understood that the constructive solution in question can be used in hermetic rotary vertical-shaft compressors and in hermetic compressors of the reciprocating piston type, merely by changing the position of the pump along the crankshaft and the lubricant oil suction and discharge tubes. It should also be understood that even through the present description has been done considering a specific type of oil pump, the invention is not limited to the utilization of that type of pump, since the technical effects thereof are equally achieved with pumps of the most varied construction types.

I claim:

1. A gas and oil cooling system for a hermetic compressor comprising:

a sealed housing, a cylinder within the housing, an electric motor within the housing, a shaft moved by said motor, said compressor having a piston driven by said shaft within said cylinder and defining suction and compression chambers with the cylinder, outlet and return conduits for said shell, the shell serving as a sump for the oil, heat exchanger means external to said shell to which said shell outlet and return conduits are connected, oil pumping means in the shell having an inlet in communication with the oil sump and an outlet, said shaft having an axial bore having one end in communication with the oil pumping means outlet for conveying the oil from the oil pumping means, the shell outlet conduit having one end in communication with one end of the shaft axial bore and its other end connected to the heat exchanger means, means for supplying refrigerant gas to said shaft axial bore to travel with the oil through said axial bore to the outlet conduit and the heat exchanger, the oil and gas leaving the heat exchanger being returned to the shell through said return conduit.

2. A gas and oil cooling system as in claim 1 wherein the means for supplying refrigerant gas is in communication with said other end of the shaft axial bore.

3. A gas and oil cooling system as in claim 1 wherein the return conduit within the shell is arranged to spray oil returned from the heat exchanger onto the electric motor.

4. A gas and oil cooling system as in claim 1 wherein said heat exchanger is at a higher positional level than the oil in the sump.

5. A gas and oil cooling system as in claim 1 further comprising a bearing with a flanged portion within which the shaft rotates, said oil pumping means including a passage through the bearing flanged portion.

6. A gas and oil cooling system as in claim 5 wherein said compressor piston is an eccentric portion on said shaft which is rotated by the electric motor, a radial channel through the piston eccentric portion to discharge oil from the shaft axial bore.

7. A gas and oil cooling system as in claim 2 wherein said piston is an eccentric portion on said shaft, said shaft being rotated by the said electric motor, a main bearing in said housing for supporting the rotating shaft, said oil pumping means including a channel through a part of said main bearing with an outlet in communication with said other end of said shaft axial bore.

8. A gas and oil cooling system as in claim 7 wherein said means for supplying refrigerant gas comprises an extension on the other end of the shaft axial bore.

9. A gas and oil cooling system as in claim 8 further comprising a radial channel through the piston eccentric portion to discharge the oil from the shaft axial bore.

10. A gas and oil cooling system as in claim 9 further comprising a rotating fitting within the housing coupling the end of the shaft having the one end of the axial bore to the shell outlet conduit.

11. A gas and oil cooling system as in claim 9 further comprising a discharge muffler in communication with the cylinder discharge chamber, said other end of the shaft axial bore being in fluid communication with said discharge muffler.

* * * * *

UNITED STATES PATENT AND TRADEMARK OFFICE

CERTIFICATE OF CORRECTION

PATENT NO. : 4,968,223
DATED : November 6, 1990
INVENTOR(S) : Caio M.F.N. Da Costa It is certified that error appears in the above-identified patent and that said Letters Patent is hereby corrected as shown below:

On the title page of the patent, at Section [73], please delete "Empresa Brasiliera de Compressores" and substitute therefor --Empresa Brasileira de Compressores S/A-EMBRACO--.

Signed and Sealed this
Thirteenth Day of September, 1994

*Attest:*

*Attesting Officer*

BRUCE LEHMAN

*Commissioner of Patents and Trademarks*